US009299523B1

(12) United States Patent
Whipple et al.

(10) Patent No.: US 9,299,523 B1
(45) Date of Patent: Mar. 29, 2016

(54) SWITCHING DEVICE ASSEMBLY AND ADAPTER ASSEMBLY THEREFOR

(71) Applicant: EATON CORPORATION, Cleveland, OH (US)

(72) Inventors: Michael Jerome Whipple, Rochester, PA (US); Robert Edwin Handick, Jr., Bulger, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/568,296

(22) Filed: Dec. 12, 2014

(51) Int. Cl.
*H01H 71/10* (2006.01)
*H01H 71/02* (2006.01)
*H01R 31/06* (2006.01)
*H01R 9/18* (2006.01)

(52) U.S. Cl.
CPC ..... *H01H 71/1045* (2013.01); *H01H 71/0207* (2013.01); *H01R 9/18* (2013.01); *H01R 31/06* (2013.01)

(58) Field of Classification Search
CPC ..... H01R 9/18; H01H 71/1045
USPC ..... 439/709, 810–814
See application file for complete search history.

(56) References Cited

U.S. PATENT DOCUMENTS 2,285,928 A * 6/1942 Jensen ..... H01R 4/36 200/284
2,780,793 A * 2/1957 Gambale ..... H01R 4/62 439/812
2,907,978 A * 10/1959 Bergan ..... H01R 4/363 439/793
3,066,277 A * 11/1962 Edmunds ..... H01R 9/18 174/86
3,076,952 A * 2/1963 Powell ..... H01R 9/16 439/718
3,165,372 A * 1/1965 Jacobs ..... H01R 9/22 174/72 R
3,335,399 A * 8/1967 Rys ..... H01H 1/5855 439/739
3,344,394 A * 9/1967 Kingsbury ..... H01H 71/08 200/237
3,638,173 A * 1/1972 Middendorf ..... H01R 4/36 403/362
3,747,052 A * 7/1973 Sheldon ..... H01R 4/36 439/814
3,888,560 A * 6/1975 Smith ..... H01H 71/08 200/284
3,891,298 A * 6/1975 Yorgin ..... H01H 71/08 439/620.08
4,027,940 A * 6/1977 Mazzeo ..... H01R 4/366 439/812
4,171,152 A * 10/1979 Geiseler ..... H05K 3/306 439/715

(Continued)

*Primary Examiner* — Ross Gushi
(74) *Attorney, Agent, or Firm* — Eckert Seamans Cherin & Mellott, LLC; John P. Powers; Grant E. Coffield

(57) ABSTRACT

An adapter assembly is for a switching device assembly of an electrical system. The electrical system includes a bus assembly. The switching device assembly includes at least one cable and at least one electrical switching apparatus. The cable is electrically connected to the bus assembly. The electrical switching apparatus has a switching device lug member, a switching device lug fastener, and a load terminal. The switching device lug fastener connects the load terminal to the switching device lug member. The adapter assembly includes: a housing assembly having a base member; and at least one interconnect assembly including: an adapter lug member coupled to the base member, the adapter lug member receiving the cable, an adapter fastener securing the cable to the adapter lug member, and an adapter terminal coupled to the adapter lug member and the switching device lug member in order to provide an electrical pathway therebetween.

20 Claims, 7 Drawing Sheets

(56) References Cited

U.S. PATENT DOCUMENTS 4,213,669 A * 7/1980 Wittes ..... H01R 4/36 439/811
4,603,376 A * 7/1986 Maier ..... H01R 4/36 200/284
4,669,806 A * 6/1987 Fuchs ..... H01R 4/363 439/712
4,693,542 A * 9/1987 Heng ..... H01R 4/363 439/626
5,005,104 A * 4/1991 Grunert ..... H01H 71/08 335/202
5,030,131 A * 7/1991 Boehm ..... H01R 4/36 439/387
5,064,384 A * 11/1991 Weaver ..... H01R 9/2675 439/511
5,107,396 A * 4/1992 Rosen ..... H01H 71/08 361/634
5,206,789 A * 4/1993 Barbry ..... H01H 71/08 200/284
5,269,710 A * 12/1993 Donnerstag ..... H01H 71/08 439/810
5,533,913 A * 7/1996 Boehm ..... H01R 4/36 439/810
5,753,877 A * 5/1998 Hartzel ..... H01H 9/342 218/157
5,811,749 A * 9/1998 Bausch ..... H01H 9/342 200/306
5,831,498 A * 11/1998 Maloney ..... H01H 9/0264 335/202
5,944,551 A * 8/1999 Kline ..... H01R 4/36 439/418
5,978,208 A * 11/1999 Helms ..... H01H 1/5855 200/284
6,036,542 A * 3/2000 Montague ..... H02B 1/04 439/575
6,084,188 A * 7/2000 Mueller ..... H01H 71/08 200/305
6,129,595 A * 10/2000 Scanlon ..... H02B 1/056 361/637
6,211,759 B1 * 4/2001 Little ..... H01H 9/0264 335/202
6,213,818 B1 * 4/2001 Chadbourne ..... H01R 4/36 439/224
6,280,264 B1 * 8/2001 Whipple ..... H01H 11/0031 335/202
6,338,658 B1 * 1/2002 Sweeney ..... H01R 4/36 439/709
6,361,382 B1 * 3/2002 Yamada ..... H01R 4/302 439/801
6,407,354 B1 * 6/2002 Turner ..... H01H 9/342 218/155
6,437,268 B1 * 8/2002 Etscheidt ..... H01H 71/08 200/305
6,529,112 B1 * 3/2003 Leone ..... H01R 4/36 337/113
6,589,071 B1 * 7/2003 Lias ..... H01H 71/08 439/511
6,612,878 B2 * 9/2003 Lias ..... H01R 9/24 439/507
6,624,375 B2 * 9/2003 Leone ..... H01H 9/342 218/155
6,692,296 B2 * 2/2004 Lias ..... H01R 9/226 439/507
6,733,347 B2 * 5/2004 Palet Mercader ..... H01H 71/08 439/810
6,781,491 B2 * 8/2004 Whipple ..... H01R 31/06 335/202
6,814,628 B2 * 11/2004 Chadbourne ..... H01R 9/2408 439/717
6,838,962 B2 * 1/2005 Leone ..... H01H 9/342 335/16
6,923,680 B2 * 8/2005 Dumont ..... H01R 9/2416 439/582
6,930,577 B2 * 8/2005 Subramanian ..... H01H 1/2058 200/304
6,942,527 B1 * 9/2005 Lias ..... H01H 11/0031 335/202
7,009,132 B1 * 3/2006 Shea ..... H01H 9/342 218/155
7,075,021 B2 7/2006 Rowe et al.
7,097,502 B2 * 8/2006 Landis ..... H01R 4/36 439/595
7,132,913 B2 * 11/2006 Whipple ..... H01H 11/0031 335/202
7,364,476 B2 * 4/2008 Mueller ..... H01R 4/36 439/709
7,540,792 B2 * 6/2009 Ananthakrishnan . H01H 50/543 335/202
7,586,057 B2 * 9/2009 Sisson ..... H01H 9/342 200/293
7,786,831 B2 * 8/2010 Oh ..... H01H 71/08 200/293
7,798,869 B1 * 9/2010 Konopacki ..... H01R 4/363 439/812
7,927,156 B2 * 4/2011 Appel ..... H05K 1/0256 439/709
8,017,881 B2 * 9/2011 Simmons ..... H01H 71/08 200/293
8,105,118 B2 * 1/2012 Claprood, Jr. ..... H01R 4/304 439/709
8,157,603 B2 * 4/2012 Trico ..... H01R 4/307 439/810
8,297,901 B2 * 10/2012 Raabe ..... B21H 3/02 411/393
8,348,706 B2 * 1/2013 Yu ..... H01R 4/36 439/737
8,485,852 B2 * 7/2013 Wu ..... H01R 4/36 439/814
8,602,829 B2 * 12/2013 Kosyanchuk ..... H01R 4/363 439/813
8,698,023 B2 * 4/2014 Grunwald ..... H01H 71/08 200/303
8,853,576 B2 * 10/2014 Sisley ..... H01H 77/00 200/304
8,870,608 B2 * 10/2014 Weiden ..... H01R 4/4818 439/811
8,870,609 B2 * 10/2014 Eberts ..... H01H 71/08 439/814
8,998,657 B1 * 4/2015 Von Eckroth ..... H01R 13/114 439/810
9,082,560 B2 * 7/2015 Helms ..... H01H 1/06
2002/0144978 A1 * 10/2002 Leone ..... H01H 9/342 218/154
2003/0148658 A1 * 8/2003 Lias ..... H01R 31/08 439/511
2005/0255757 A1 * 11/2005 Takaya ..... H01R 4/363 439/812
2007/0293096 A1 * 12/2007 Hackemack ..... H01R 9/2458 439/709
2011/0294363 A1 * 12/2011 Yeh ..... H01R 4/38 439/709

* cited by examiner

SWITCHING DEVICE ASSEMBLY AND ADAPTER ASSEMBLY THEREFOR

BACKGROUND

1. Field

The disclosed concept pertains generally to switching device assemblies and, more particularly to switching device assemblies including for example electrical switching apparatus. The disclosed concept also pertains to adapter assemblies for switching device assemblies.

2. Background Information

Known switching device assemblies include electrical switching apparatus, such as but not limited to molded case circuit breakers. A circuit breaker includes a non-conductive housing assembly that encloses a pair of separable contacts, an operating mechanism, a trip device, and other components. External to the enclosed space, the circuit breaker includes a terminal screw and a conductive terminal lug. The terminal lug is structured to be coupled to, and placed in electrical communication with, an external conductor, typically a line or load conductor. The external conductor may be, but is not limited to, a generally cylindrical cable. As such, the terminal lug may define a circular bore or opening into which the cable may be placed.

The terminal screw is movably coupled to the terminal lug and is structured to secure the cable to the terminal lug. That is, the terminal screw is structured to move between two positions, a first position, wherein the terminal screw is not set, and a second position, wherein the terminal screw is set. For example, the terminal lug may include a threaded bore that is contiguous with the opening for the cable. When the terminal screw is in the first position, the terminal screw does not bias the cable against the terminal lug. When the cable is located in the terminal lug bore and the terminal screw is moved into the set, second position, the terminal screw biases the cable against the terminal lug. That is, the terminal screw is drawn tight against the cable.

Known electrical switching apparatus may become undesirably limited by the size of the cable they can receive. For example, in certain situations it may be necessary to employ a larger cable, such as to accommodate regulatory changes (e.g., changes to the National Electric Code (NEC)), or during a longer run period to address voltage drop issues.

There is, therefore, room for improvement in switching device assemblies and in adapter assemblies therefor.

SUMMARY

These needs and others are met by embodiments of the disclosed concept, which are directed to a switching device assembly and adapter assembly therefor, which among other benefits, allow a number of relatively large cables to be received by a corresponding number of electrical switching apparatus.

In accordance with one aspect of the disclosed concept, an adapter assembly for a switching device assembly of an electrical system is provided. The electrical system includes at least one bus assembly. The switching device assembly includes at least one cable and at least one electrical switching apparatus. The cable is electrically connected to the bus assembly. The electrical switching apparatus includes a switching device lug member, a switching device lug fastener, and a load terminal. The switching device lug fastener connects the load terminal to the switching device lug member. The adapter assembly comprises: a housing assembly comprising a base member; and at least one interconnect assembly comprising: an adapter lug member coupled to the base member, the adapter lug member being structured to receive the cable, an adapter fastener structured to secure the cable to the adapter lug member, and an adapter terminal coupled to the adapter lug member and structured to be connected to the switching device lug member in order to provide an electrical pathway therebetween.

As another aspect of the disclosed concept, a switching device assembly for an electrical system is provided. The electrical system includes a bus assembly. The switching device assembly comprises: at least one cable electrically connected to the bus assembly; at least one electrical switching apparatus comprising: a switching device lug member, a switching device lug fastener, and a load terminal, the switching device lug fastener connecting the load terminal to the switching device lug member; and an adapter assembly comprising: a housing assembly comprising a base member, and at least one interconnect assembly comprising: an adapter lug member coupled to the base member, the adapter lug member receiving the cable, an adapter fastener securing the cable to the adapter lug member, and an adapter terminal coupled to each of the adapter lug member and the switching device lug member in order to provide an electrical pathway therebetween.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "coupling member" refers to any suitable connecting or tightening mechanism expressly including, but not limited to, rivets, screws, bolts and the combinations of bolts and nuts (e.g., without limitation, lock nuts) and bolts, washers and nuts.

As employed herein, the term "clearance hole" shall refer to a hole in a component, such as a cover, that is structured to receive an external component, such as a coupling member of a meter stack, in order to minimize clearance distance between the meter stack and the cover.

As employed herein, the term "lug member" shall refer to a lug member that is structured to receive a cable, or range of cables, of a predetermined size. For example, a 2/0 lug member is structured to receive cables up to a maximum size of a 2/0 AWG (American Wire Gauge) cable (i.e., cable having a cross sectional area of around 88 square millimeters per AWG standards, measured without insulation). Likewise, a 4/0 lug member is structured to receive cables up to a maximum size of a 4/0 AWG cable (i.e., cable having a cross sectional area of around 141 square millimeters per AWG standards, measured without insulation).

As employed herein, the term "batwing" shall refer to a recessed region in a lug member into which a cable is pressed, thereby strengthening the connection between the cable and the lug member.

As employed herein, the phrase "directly received" shall mean that one component, such as a cable, extends into and engages another component, such as a lug member.

As employed herein, the phrase "indirectly received" shall mean that one component, such as a cable, is spaced from (i.e., does not engage), but is electrically connected with another component, such as a lug member.

Figure 1:
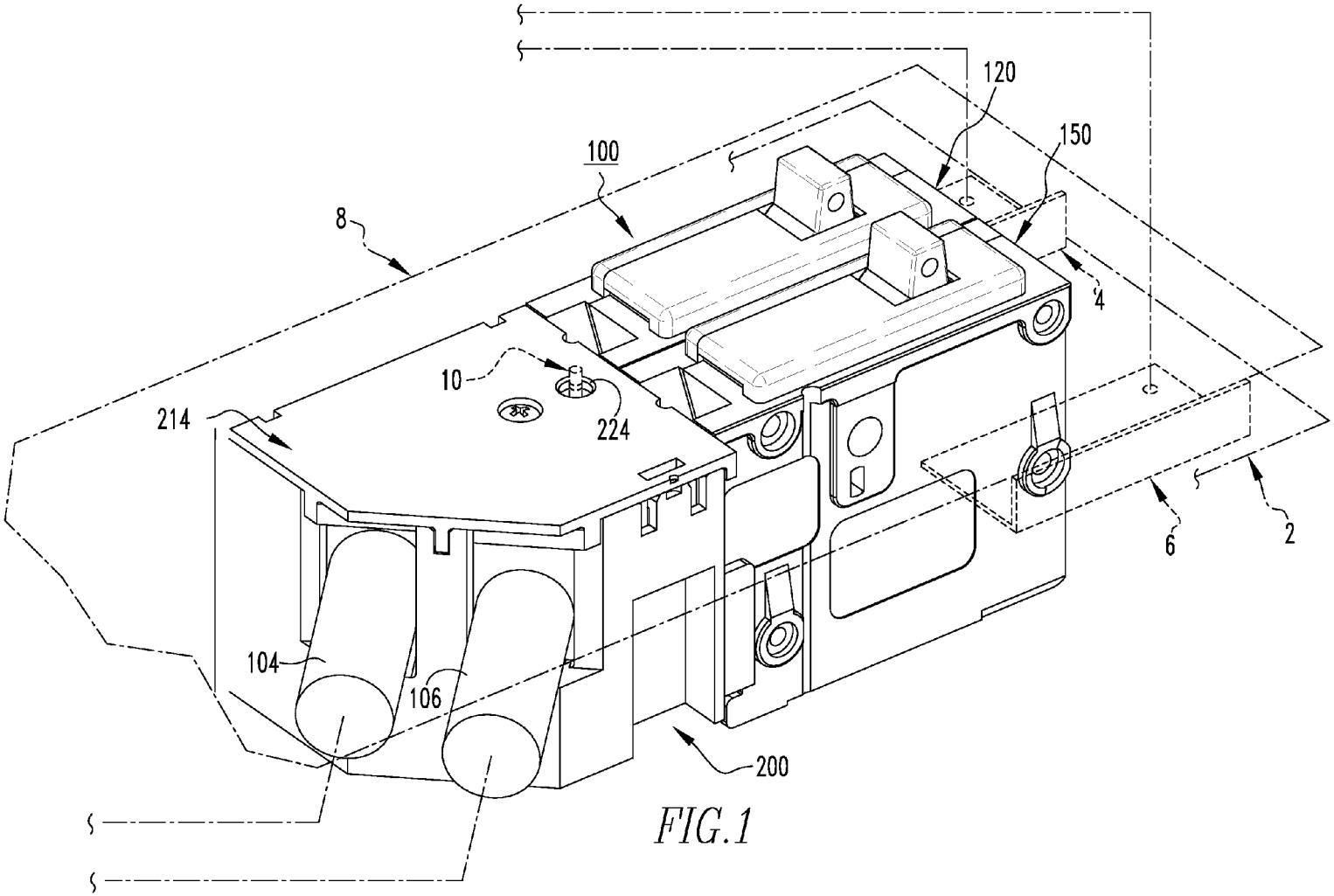
FIG. 1 is an isometric view of a switching device assembly, partially shown in simplified form, and adapter assembly therefor, in accordance with a non-limiting embodiment of the disclosed concept.

FIG. 1 shows a switching device assembly 100 in accordance with a non-limiting embodiment of the disclosed concept. The example switching device assembly 100 is for an electrical system (e.g., meter stack 2, shown in simplified form in phantom line drawing). The switching device assembly 100 includes a number of cables 104,106 (partially shown in simplified form in FIG. 1), a number of electrical switching apparatus (e.g., circuit breakers 120,150), and an adapter assembly 200. The meter stack 2 includes a number of bus assemblies 4,6. Each of the cables 104,106 is electrically connected with a respective one of the bus assemblies 4,6. The cables 104,106 are each preferably 4/0 AWG cables (i.e., have a cross sectional area of around 141 square millimeters per AWG standards, measured without insulation).

Figure 2:
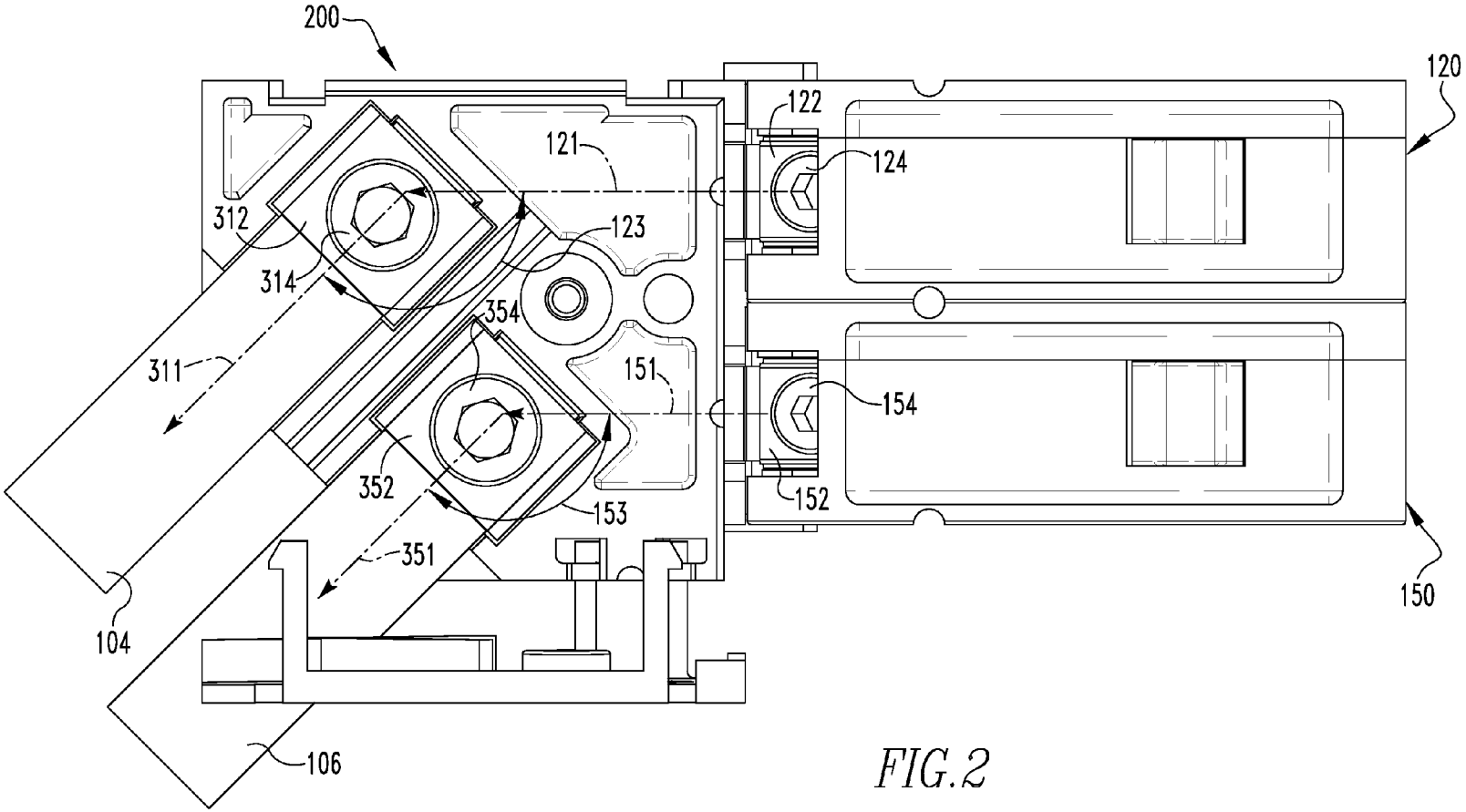
FIG. 2 is a top plan view of a portion of the switching device assembly and adapter assembly therefor of FIG. 1, shown with the cover open in order to see hidden structures.

As shown in FIG. 2, the circuit breakers 120,150 each include a respective switching device lug member 122,152 and a respective switching device lug fastener 124,154. The switching device lug members 122,152 are each preferably 2/0 lug members. Thus, it will be appreciated that the switching device lug members 122,152 are not structured to directly receive the respective cables 104,106. As will be discussed below, the adapter assembly 200 advantageously allows the relatively large cables 104,106 to be indirectly received by the respective switching device lug members 122,152, thereby electrically connecting the respective cables 104,106 with the respective circuit breakers 120,150.

Figure 3:
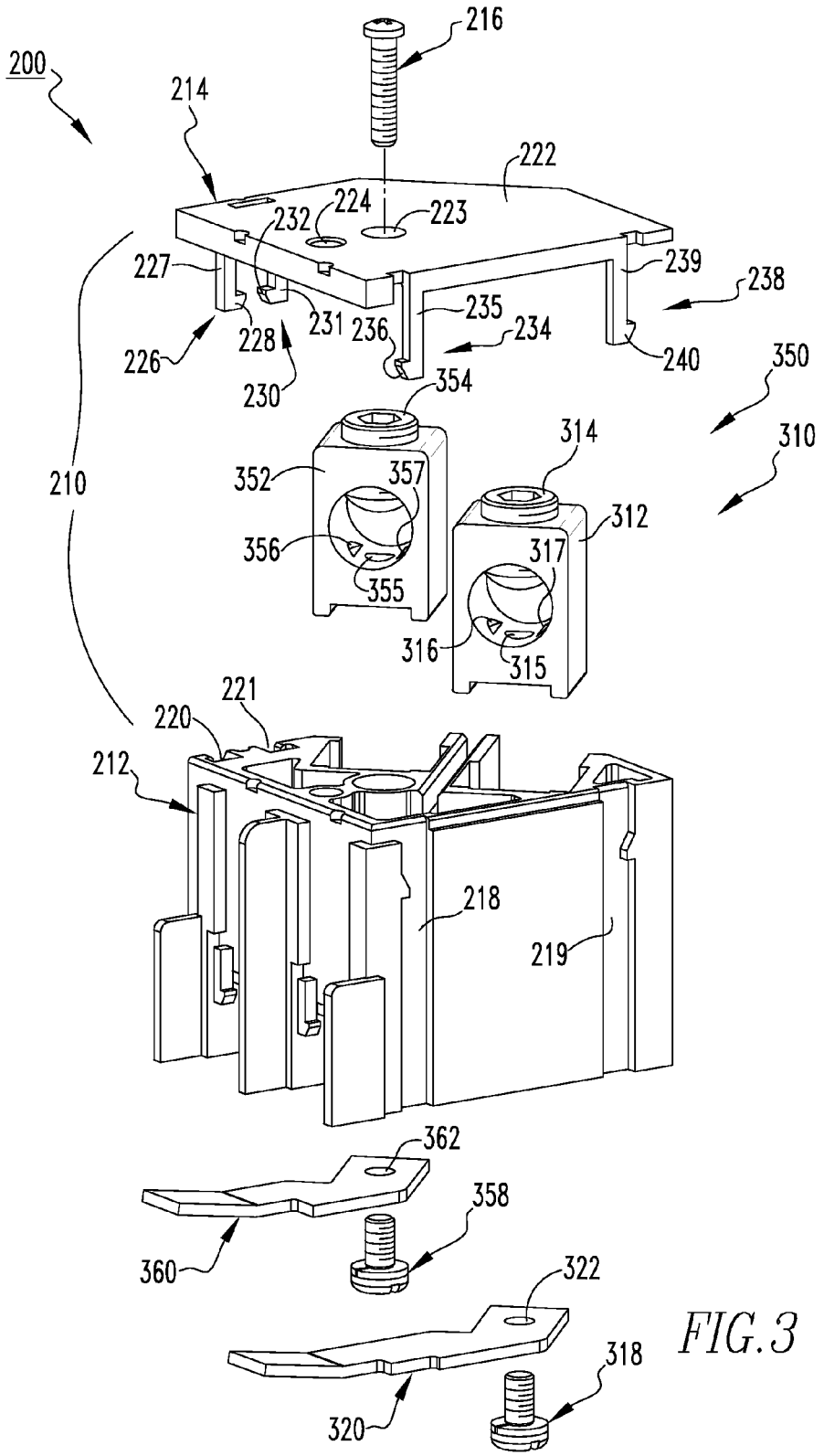
FIG. 3 is an exploded isometric view of the adapter assembly of FIG. 2.

As shown in FIG. 3, the example adapter assembly 200 includes a housing assembly 210 and a number of interconnect assemblies 310,350 (two are shown). The interconnect assemblies 310,350 each provide an electrical pathway between the respective cables 104,106 (FIG. 1 and FIG. 2) and the respective circuit breakers 120,150 (FIG. 1 and FIG. 2). The housing assembly 210 supports each of the interconnect assemblies 310,350 and electrically insulates the first interconnect assembly 310 from the second interconnect assembly 350. The housing assembly 210 includes a base member 212, a cover 214, and a coupling member (e.g., screw 216). The base member 212 and the cover 214 are each preferably injection molded components (e.g., without limitation, made of a thermoplastic material).

Each of the interconnect assemblies 310,350 includes a respective adapter lug member 312,352, a respective adapter fastener 314,354, a respective coupling member 318,358, and a respective adapter terminal 320,360. The adapter lug members 312,352 are each preferably 4/0 lug members that directly receive the respective cables 104,106 (FIG. 1 and FIG. 2). Each of the adapter fasteners 314,354 is a set screw that secures a corresponding one of the cables 104,106 to the respective adapter lug members 312,352. More specifically, the adapter fastener 314 presses (i.e., forces) the cable 104 into the adapter lug member 312. The adapter fastener 354 presses (i.e., forces) the cable 106 into the adapter lug member 352. Additionally, as shown in FIG. 3, each of the adapter lug members 312,352 includes a number of batwings (two batwings 316,317 are shown on the adapter lug member 312, and two batwings 356,357 are shown on the adapter lug member 352). In operation, the adapter fasteners 314,354 press the respective cables 104,106 (FIG. 1 and FIG. 2) into the respective batwings 316,317,356,357 in order to strengthen the connection between the cables 104,106 (FIG. 1 and FIG. 2) and the respective adapter lug members 312, 352.

Continuing to refer to FIG. 3, in operation, the cover 214 of the housing assembly 210 is removably coupled to the base member 212, and each of the adapter lug members 312,352 is coupled to the base member 212 and located internal with respect to the cover 214 and the base member 212. Thus, the cover 214 and the base member 212 house and protect the adapter lug members 312,352 and the adapter fasteners 314, 354. The cover 214 is in part coupled to the base member 212 by a snap-fit mechanism. Specifically, the base member 212 includes a number of slots 218,219,220,221. The cover 214 includes a mounting portion 222 and a number of flexible retention members 226,230,234,238. Each of the flexible retention members 226,230,234,238 includes a respective elongated portion 227,231,235,239 and a respective hook portion 228,232,236,240. The elongated portions 227,231, 235,239 extend from the mounting portion 222. The hook portions 228,232,236,240 extend from the respective elongated portions 227,231,235,239 and are spaced from the mounting portion 222. During assembly, once the adapter lug members 312,352 and the adapter fasteners 314,354 are located within the base member 212, each of the flexible retention members 226,230,234,238 slides within a corresponding one of the slots 218,219,220,221, and the hook portions 228,232,236,240 advantageously allow the cover 214 to be secured. In this manner, the flexible retention members 226,230,234,238 maintain the cover 214 on the base member 212

Figure 4:
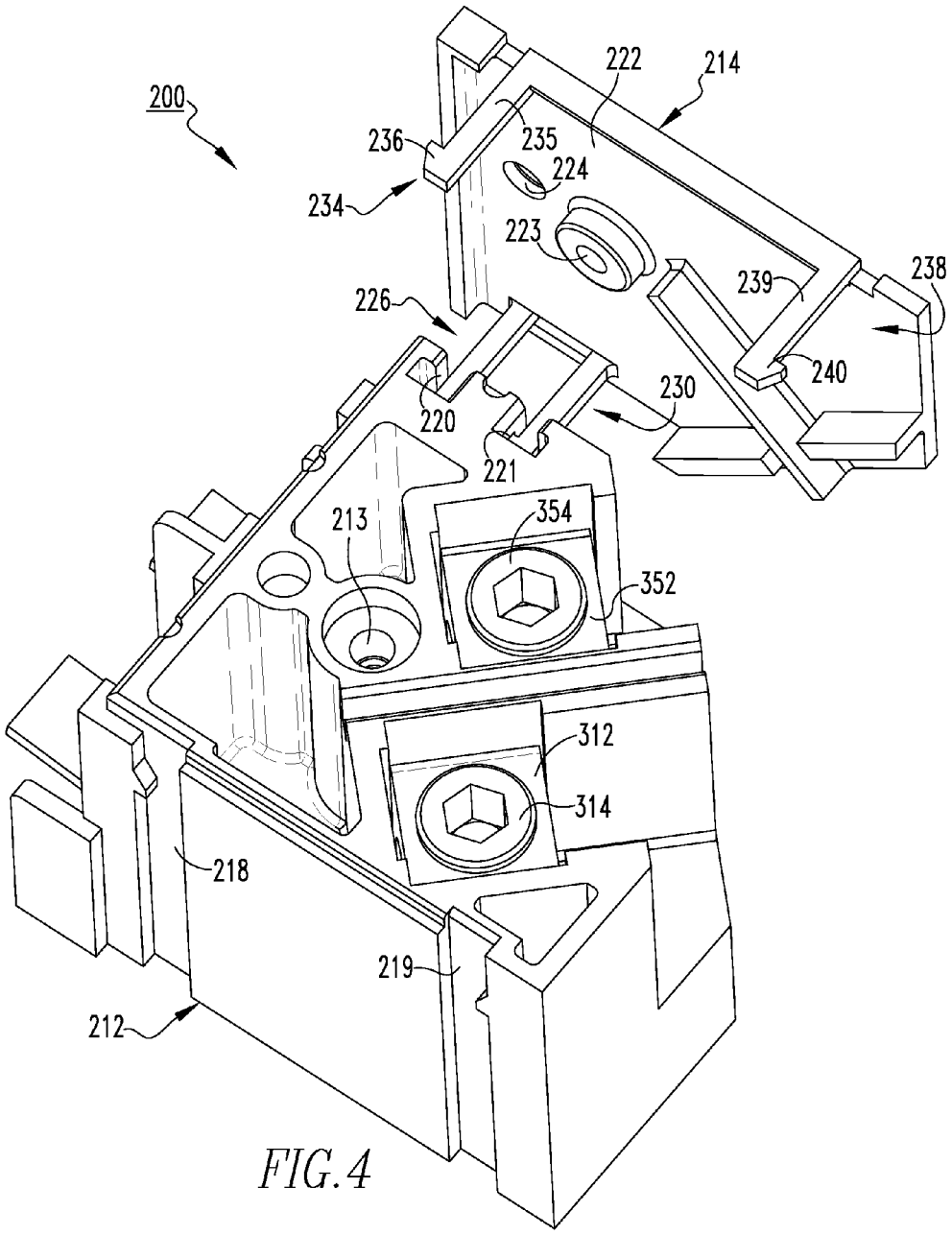
FIG. 4 is a partially assembled isometric view of the adapter assembly of FIG. 3, shown with the cover open in order to see hidden structures.
Figure 5:
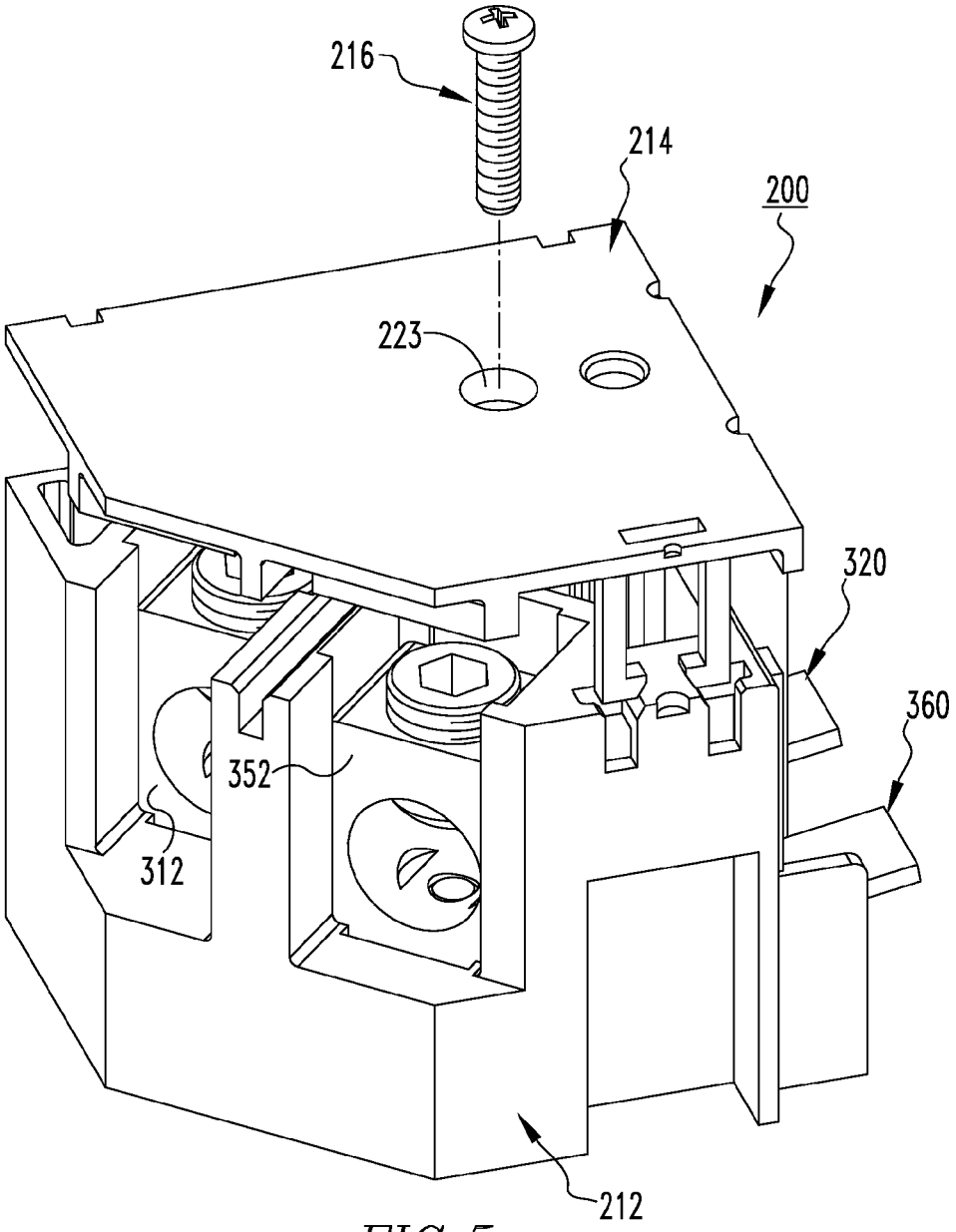
FIG. 5 is a partially exploded isometric view of the adapter assembly of FIG. 4.
Figure 6:
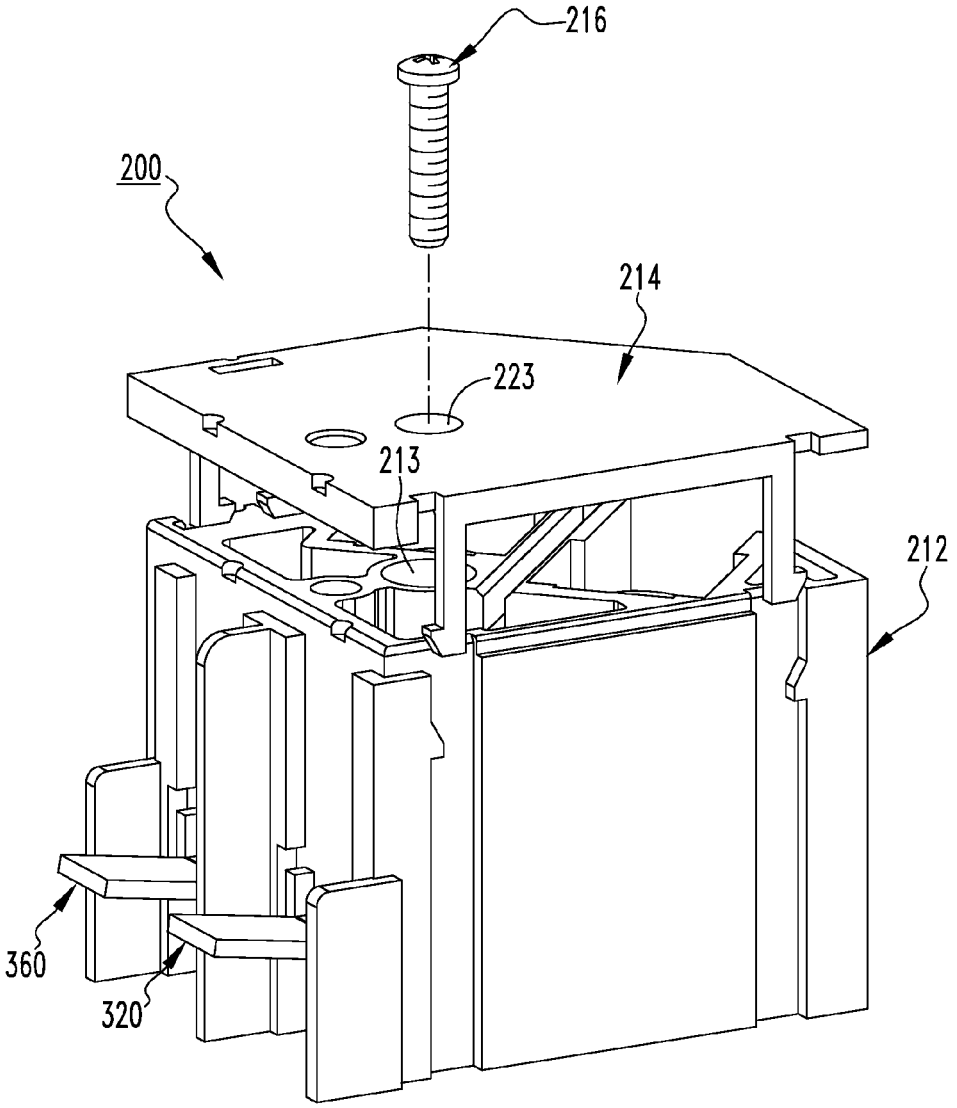
FIG. 6 is another partially exploded isometric view of the adapter assembly of FIG. 5.

As shown in FIG. 4, the cover 214 has a thru hole 223 and the base member 212 has an aperture 213. Referring to FIG. 5 and FIG. 6, the screw 216 extends through the thru hole 223 and into the aperture 213 (FIG. 6) in order to further couple the cover 214 to the base member 212. Thus, in addition to being coupled to the base member 212 by a snap-fit mechanism, the cover 214 is further secured to the base member 212 by way of the screw 216.

Figure 7:
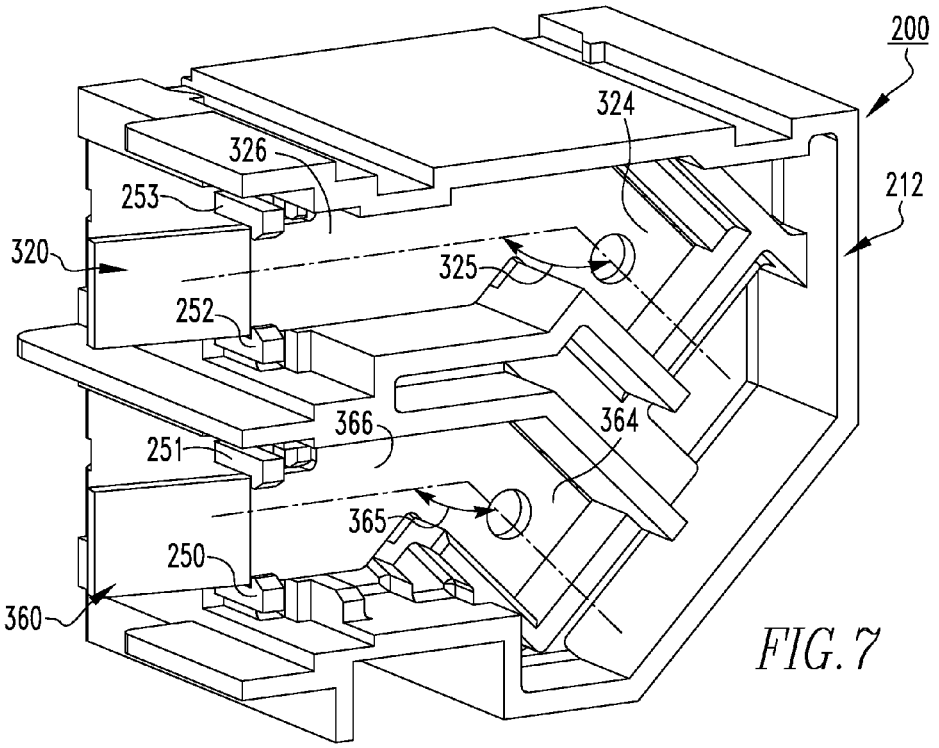
FIG. 7 is a rear isometric view of a portion of the adapter assembly of FIG. 6.

Referring to FIG. 7, each of the adapter terminals 320,360 includes a first elongated portion 324,364 and a second elongated portion 326,366 extending from the first elongated portion 324,364. The first elongated portions 324,364 are each at a respective angle 325,365 with respect to the second elongated portions 326,366. The angles 325,365 are each preferably between 125 degrees and 145 degrees. The adapter lug members 312,352 (FIG. 2) are oriented in a similar configuration with respect to the switching device lug members 122, 152 (FIG. 2). As shown in FIG. 2, the switching device lug members 122,152 face in a first direction 121,151 and the adapter lug members 312,352 face in a second direction 311, 351. The first directions 121,151 are at an angle 123,153 of between 125 degrees and 145 degrees with respect to the second directions 311,351. As a result of this configuration, bending of the cables 104,106 (FIG. 1 and FIG. 2) is advantageously minimized. In other words, the cables 104,106 (FIG. 1 and FIG. 2) do not need to be bent any more than as depicted in FIG. 1 in order to be indirectly received by the circuit breakers 120,150 (FIG. 1 and FIG. 2). Moreover, it will be appreciated that the first elongated portions 324,364 are each coupled to the respective adapter lug members 312,352, and the second elongated portions 326,366 are each connected to the respective switching device lug members 122, 152. As a result, the adapter terminals 320,360 provide an electrical pathway between the respective adapter lug members 312,352 and the respective switching device lug members 122,152.

Figure 8:
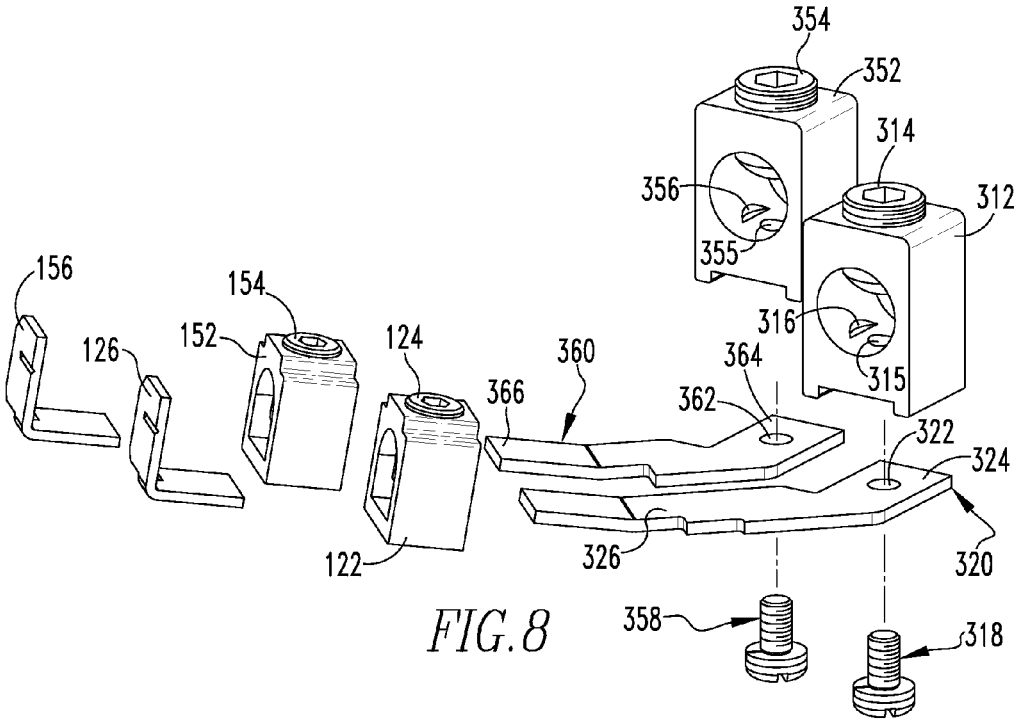
FIG. 8 is an exploded isometric view of a portion of the switching device assembly of FIG. 1.

More specifically, and with reference to FIG. 8, the adapter terminals 320,360 each have a respective thru hole 322,362. The adapter lug members 312,352 each have an aperture 315,355. In operation, the coupling members 318,358 extend through the respective thru holes 322,362 of the adapter terminals 320,360 and into the respective apertures 315,355 of the adapter lug members 312,352. Thus, the coupling members 318,358 are connected with the respective adapter lug members 312,352 and the respective adapter terminals 320, 360 in order to electrically connect the adapter lug members 312,352 to the adapter terminals 320,360. The coupling members 318,358 also partially secure the adapter terminals 320, 360 to the base member 212.

In addition, each of the adapter terminals 320,360 is also coupled to the base member 212 by a snap-fit mechanism. Referring to FIG. 7, the base member 212 includes a number of flexible retention members 250,251,252,253. The adapter terminal 320 is located between the flexible retention members 252,253. Similarly, the adapter terminal 360 is located between the flexible retention members 250,251. It will be appreciated that during assembly, when the adapter terminals 320,360 are pressed between the respective flexible retention members 250,251,252,253, the flexible retention members deflect in order to allow the respective adapter terminals 320,360 to be securely mounted on the base member 212.

As shown in FIG. 8, the second elongated portions 326,366 of the adapter terminals 320,360 are structured to extend into the respective switching device lug members 122,152. Similarly, the load terminals 126,156 extend into the respective switching device lug members 122,152. The adapter terminals 320,360 are located between the respective switching device lug fasteners 124,154 and the respective load terminals 126,156. Furthermore, each of the switching device lug fasteners 124,154 forces (i.e., presses) the respective adapter terminal 320,360 into the respective load terminal 126,156. Thus, the switching device lug fasteners 124,154 connect the respective load terminals 126,156 and the respective adapter terminals 320,360 to the respective switching device lug members 122,152. As a result, each of the cables 104,106 is electrically connected with a corresponding one of the circuit breakers 120,150. Thus, although the circuit breakers 120, 150 do not directly receive the respective cables 104,106, the adapter assembly 200 advantageously allows the relatively large cables 104,106 to be indirectly received by the respective circuit breakers 120,150.

Referring again to FIG. 1, the meter stack 2 further includes a plate member 8 (shown in simplified form in phantom line drawing) and a coupling member 10 (shown in simplified form in phantom line drawing) coupled to the plate member 8. The plate member 8 partially overlays (i.e., when viewed from a top plan view, is on top of) the adapter assembly 200 and is coupled to the bus assemblies 4,6. Additionally, the cover 214 has a clearance hole 224. As shown, the clearance hole 224 receives the coupling member 10. In this manner, the adapter assembly 200 advantageously accommodates the coupling member 10 without any undesirable interference. It will, however, be appreciated that having a clearance hole is not meant to be a limiting aspect to the disclosed concept. Specifically, suitable alternative adapter assemblies (not shown) employed in other electrical systems (not shown) may not require a clearance hole.

Although the disclosed concept has been described in association with the meter stack 2 (FIG. 1), it will be appreciated that the adapter assembly 200 or a similar suitable alternative adapter assembly (not shown) may be implemented with other electrical systems (e.g., load centers). Additionally, while the disclosed concept has been described in association with the relatively large 4/0 AWG cables 104,106 (FIG. 1 and FIG. 2) being indirectly received by the 2/0 lug members 312,352, it will be appreciated that a similar suitable alternative adapter assembly (not shown) may be employed in order to perform the desired function of allowing a number of cables (not shown) of a given size to be indirectly received by a corresponding number of lug members (not shown) of a different size (i.e., lug members structured to receive a cable of a different size).

Accordingly, it will be appreciated that the disclosed concept provides for an improved (e.g., without limitation, more versatile, more accommodating) switching device assembly 100 and adapter assembly 200 therefor, which among other benefits, allows a number of relatively large cables 104,106 to be indirectly received by a number of circuit breakers 120, 150, as desired.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An adapter assembly for a switching device assembly of an electrical system, said electrical system comprising at least one bus assembly, said switching device assembly comprising at least one cable and at least one electrical switching apparatus, said at least one cable being electrically connected to said at least one bus assembly, said at least one electrical switching apparatus comprising a switching device lug member, a switching device lug fastener, and a load terminal, said switching device lug fastener connecting said load terminal to said switching device lug member, said adapter assembly comprising:

a housing assembly comprising a base member; and at least one interconnect assembly comprising:

an adapter lug member coupled to said base member, said adapter lug member being structured to receive said at least one cable, an adapter fastener structured to secure said at least one cable to said adapter lug member, and an adapter terminal coupled to said adapter lug member and structured to be connected to said switching device lug member in order to provide an electrical pathway therebetween, wherein said at least one interconnect assembly further comprises a coupling member; wherein said adapter terminal has a thru hole; wherein said coupling member extends through the thru hole of said adapter terminal; wherein said coupling member is connected to said adapter lug member; wherein said adapter terminal comprises a first elongated portion and a second elongated portion; wherein the first elongated portion is coupled to said adapter lug member; wherein the second elongated portion extends from the first elongated portion; wherein the second elongated portion is structured to be connected to said switching device lug member; and wherein the first elongated portion is disposed at an angle of between 125 degrees and 145 degrees with respect to the second elongated portion.

2. The adapter assembly of claim 1 wherein said at least one interconnect assembly comprises a first interconnect assembly and a second interconnect assembly; and wherein said first interconnect assembly is electrically insulated from said second interconnect assembly.

3. The adapter assembly of claim 1 wherein said housing assembly further comprises a cover removably coupled to said base member; and wherein said adapter lug member is disposed internal with respect to said base member and said cover.

4. The adapter assembly of claim 3 wherein said cover has a clearance hole.

5. The adapter assembly of claim 3 wherein said cover comprises a mounting portion and a number of flexible retention members extending from the mounting portion; wherein said base member has a number of slots; and wherein, when each of said flexible retention members is disposed in a corresponding one of said number of slots, said flexible retention members maintain said cover on said base member.

6. The adapter assembly of claim 5 wherein each of the flexible retention members comprises an elongated portion and a hook portion; wherein the elongated portion extends from the mounting portion; wherein the hook portion extends from the elongated portion; and wherein the hook portion is spaced from the mounting portion.

7. The adapter assembly of claim 5 wherein said housing assembly further comprises a coupling member; wherein said cover has a thru hole; wherein said base member has an aperture; wherein said coupling member extends through the thru hole of said cover; and wherein said coupling member extends into the aperture of said base member in order to couple said cover to said base member.

8. An adapter assembly for a switching device assembly of an electrical system, said electrical system comprising at least one bus assembly, said switching device assembly comprising at least one cable and at least one electrical switching apparatus, said at least one cable being electrically connected to said at least one bus assembly, said at least one electrical switching apparatus comprising a switching device lug member, a switching device lug fastener, and a load terminal, said switching device lug fastener connecting said load terminal to said switching device lug member, said adapter assembly comprising:

a housing assembly comprising a base member; and at least one interconnect assembly comprising:

an adapter lug member coupled to said base member, said adapter lug member being structured to receive said at least one cable, an adapter fastener structured to secure said at least one cable to said adapter lug member, and an adapter terminal coupled to said adapter lug member and structured to be connected to said switching device lug member in order to provide an electrical pathway therebetween, wherein said adapter terminal is coupled to said base member by a snap-fit mechanism.

9. The adapter assembly of claim 8 wherein said base member comprises a first flexible retention member and a second flexible retention member; wherein said adapter terminal is disposed between said first flexible retention member and said second flexible retention member; and wherein each of said first flexible retention member and said second flexible retention member secures said adapter terminal to said base member.

10. A switching device assembly for an electrical system, said electrical system comprising at least one bus assembly, said switching device assembly comprising:

at least one cable structured to be electrically connected to said at least one bus assembly;

at least one electrical switching apparatus comprising:

a switching device lug member, a switching device lug fastener, and a load terminal, said switching device lug fastener connecting said load terminal to said switching device lug member; and an adapter assembly comprising:

a housing assembly comprising a base member, and at least one interconnect assembly comprising:

an adapter lug member coupled to said base member, said adapter lug member receiving said at least one cable, an adapter fastener securing said at least one cable to said adapter lug member, and an adapter terminal coupled to each of said adapter lug member and said switching device lug member in order to provide an electrical pathway therebetween, wherein said adapter lug member faces in a first direction; wherein said switching device lug member faces in a second direction; and wherein the first direction is disposed at an angle of between 125 degrees and 145 degrees with respect to the second direction.

11. The switching device assembly of claim 10 wherein said adapter lug member has a number of batwings; and wherein said adapter fastener presses said at least one cable into each of the number of batwings.

12. The switching device assembly of claim 10 wherein said adapter terminal extends into said switching device lug member; wherein said load terminal extends into said switching device lug member; wherein said adapter terminal is disposed between said switching device lug fastener and said load terminal; wherein said switching device lug fastener forces said adapter terminal into said load terminal, thereby electrically connecting said at least one cable to said at least one electrical switching apparatus.

13. The switching device assembly of claim 12 wherein said at least one cable comprises a first cable and a second cable; wherein said at least one electrical switching apparatus comprises a first electrical switching apparatus and a second electrical switching apparatus; wherein said at least one interconnect assembly comprises a first interconnect assembly and a second interconnect assembly; wherein said first interconnect assembly electrically connects said first cable to said first electrical switching apparatus; and wherein said second interconnect assembly electrically connects said second cable to said second electrical switching apparatus.

14. The switching device assembly of claim 13 wherein said first electrical switching apparatus is a first circuit breaker; and wherein said second electrical switching apparatus is a second circuit breaker.

15. The switching device assembly of claim 10 wherein said adapter terminal is coupled to said base member by a snap-fit mechanism.

16. The switching device assembly of claim 10 wherein said housing assembly further comprises a cover removably coupled to said base member; wherein said adapter lug member is disposed internal with respect to said base member and said cover; and wherein said cover has a clearance hole.

17. The switching device assembly of claim 10 wherein said at least one interconnect assembly further comprises a coupling member; wherein said adapter terminal has a thru hole; wherein said coupling member extends through the thru hole of said adapter terminal; wherein said coupling member is connected to said adapter lug member; wherein said adapter terminal comprises a first elongated portion and a second elongated portion; wherein the first elongated portion is coupled to said adapter lug member; wherein the second elongated portion extends from the first elongated portion; wherein the second elongated portion is structured to be connected to said switching device lug member; and wherein the first elongated portion is disposed at an angle of between 125 degrees and 145 degrees with respect to the second elongated portion.

18. The switching device assembly of claim 10 wherein said electrical system further comprises a plate member and a coupling member coupled to said plate member; wherein said plate member is coupled to said at least one bus assembly; wherein said plate member is structured to at least partially overlay said adapter assembly; wherein said housing assembly further comprises a cover removably coupled to said base member; wherein said adapter lug member is disposed internal with respect to said base member and said cover; wherein said cover has a clearance hole; and wherein said clearance hole is structured to receive said coupling member.

19. The switching device assembly of claim 10 wherein said housing assembly further comprises a cover removably coupled to said base member; wherein said adapter lug member is disposed internal with respect to said base member and said cover; wherein said cover comprises a mounting portion and a number of flexible retention members extending from the mounting portion; wherein said base member has a number of slots; and wherein, when each of said flexible retention members is disposed in a corresponding one of said number of slots, said flexible retention members maintain said cover on said base member.

20. The switching device assembly of claim 19 wherein each of the flexible retention members comprises an elongated portion and a hook portion; wherein the elongated portion extends from the mounting portion; wherein the hook portion extends from the elongated portion; and wherein the hook portion is spaced from the mounting portion.

* * * * *